United States Patent [19]

Minz et al.

[11] 4,236,983

[45] Dec. 2, 1980

[54] PROCESS AND APPARATUS FOR ELECTROLYSIS OF HYDROCHLORIC ACID

[75] Inventors: Franz-Rudolf Minz, Dormagen; Herbert Wiechers, Leverkusen, both of Fed. Rep. of Germany

[73] Assignee: Bayer Aktiengesellschaft, Leverkusen, Fed. Rep. of Germany

[21] Appl. No.: 24,748

[22] Filed: Mar. 28, 1979

[30] Foreign Application Priority Data

Apr. 14, 1978 [DE] Fed. Rep. of Germany ..... 2816152

[51] Int. Cl.[3] ..... C25B 1/02; C25B 1/26; C25B 9/00

[52] U.S. Cl. ..... 204/129; 204/128; 204/256; 204/278

[58] Field of Search ..... 204/128, 129, 256, 278

[56] References Cited

U.S. PATENT DOCUMENTS

| | | | |
|---|---|---|---|
| 1,485,461 | 3/1924 | Knowles | 204/256 |
| 2,719,822 | 10/1955 | Kassel | 204/128 |
| 3,236,760 | 2/1966 | Messner | 204/128 X |
| 3,875,040 | 4/1975 | Weltin et al. | 204/267 |
| 3,876,517 | 4/1975 | Raetzch et al. | 204/128 X |
| 3,915,836 | 10/1975 | Born et al. | 204/128 X |

FOREIGN PATENT DOCUMENTS

| | | | |
|---|---|---|---|
| 743083 | 9/1966 | Canada | 204/128 |

*Primary Examiner*—G. L. Kaplan

*Attorney, Agent, or Firm*—Sprung, Felfe, Horn, Lynch & Kramer

[57] ABSTRACT

In the production of chlorine and hydrogen from hydrochloric acid by electrolysis in an electrolysis cell comprising a plurality of vertically arranged bipolar electrodes, a diaphragm arranged between each two electrodes to divide the electrolysis chambers formed between them into an anolyte chamber and a catholyte chamber, and outlet and inlet devices for the electrolyte, the improvement which comprises electrolyzing the hydrochloric acid in at least two successive stages, and degassing the hydrochloric acid. Advantageously the hydrochloric acid moves from bottom to top, first through an upper stage and then through a lower stage. As a result less electrode surface is needed, a higher current density and/or voltage is possible so existing apparatus can be modified to connect more bipolar electrodes in series.

6 Claims, 2 Drawing Figures

PROCESS AND APPARATUS FOR ELECTROLYSIS OF HYDROCHLORIC ACID

The electrolytic production of hydrogen and chlorine from hydrochloric acid generally takes place in electrolysis cells in which there are arranged 30 to 45 vertically arranged bipolar electrodes, the electrolysis chamber formed between each two electrodes beng divided by a diaphragm. The surface of the electrode usually amounts to about 2.5 $m^2$ in area and is square in cross-section, see, for example, German Auslegeschrift No. 1,216,852 or Chem Ing. Technik 39, 731 (1967). The hydrochloric acid flows through the electrolysis chamber from the bottom to the top, hydrogen being formed in the catholyte chamber and chlorine being formed in the anolyte chamber. Catholyte and anolyte are thus enriched with gas bubbles as they pass through the electrolysis chamber. The gas bubbles are separated off once the electrolyte has left the cell.

The electrical resistance of the electrolytes and thus the specific power consumption of the electrolysis cell is increased by the presence of gas bubbles in the electrolytes. It is therefore desirable to select the residence time of the electrolytes in the cell, i.e. the time during which the gas bubbles accumulate, to be as short as possible for a given current density. Furthermore, it is necessary for the economic operation of the cell to reduce the concentration of the hydrochloric acid during the passage through the electrolysis cell. A reduction of about 25% to about 20% HCl is usually desired.

The present invention therefore relates to a process for the production of chlorine and hydrogen from hydrochloric acid by electrolysis in an electrolysis cell comprising a plurality of vertically arranged bipolar electrodes, a diaphragm being arranged between each two electrodes to divide the electrolysis chambers formed between them into an anloyte chamber and a catholyte chamber, and also outlet and inlet devices for the electrolyte, which is characterized in that the hydrochloric acid is electrolyzed in at least two successive stages and is degassed after leaving one stage and before entering the next stage at any time.

The present invention also relates to a hydrochloric acid electrolysis cell comprising a plurality of vertically arranged bipolar electrodes, a diaphragm being arranged between each two electrodes to divide the electrolysis chamber formed between them into an anolyte chamber and a catholyte chamber, and also outlet and inlet devices for the electrolyte, which is characterized in that the bipolar electrodes and the electrolysis chamber are each divided into levels in at least one horizontal plane perpendicular to the electrode surface and additional inlet and outlet devices for the electrolytes are provided in this plane so that independent electrolyte cycles are formed in each level.

The partial electrode surfaces formed by the division of the electrodes are preferably about 40 to 80 cm in height and particularly preferably approximately 60 cm in height.

The bipolar electrodes are preferably each held in holding frames which are laminated on each other in the manner of filter presses. The principle of such arrangements is described, for example, in U.S. Pat. Nos. 3,875,040 and 3,915,836. According to the invention, the electrolysis frames for holding the electrodes contain several superimposed windows, the cross-members containing inlet and outlet ducts for the electrolytes.

The invention is described in more detail below with reference to the drawing wherein.

Figure 1:
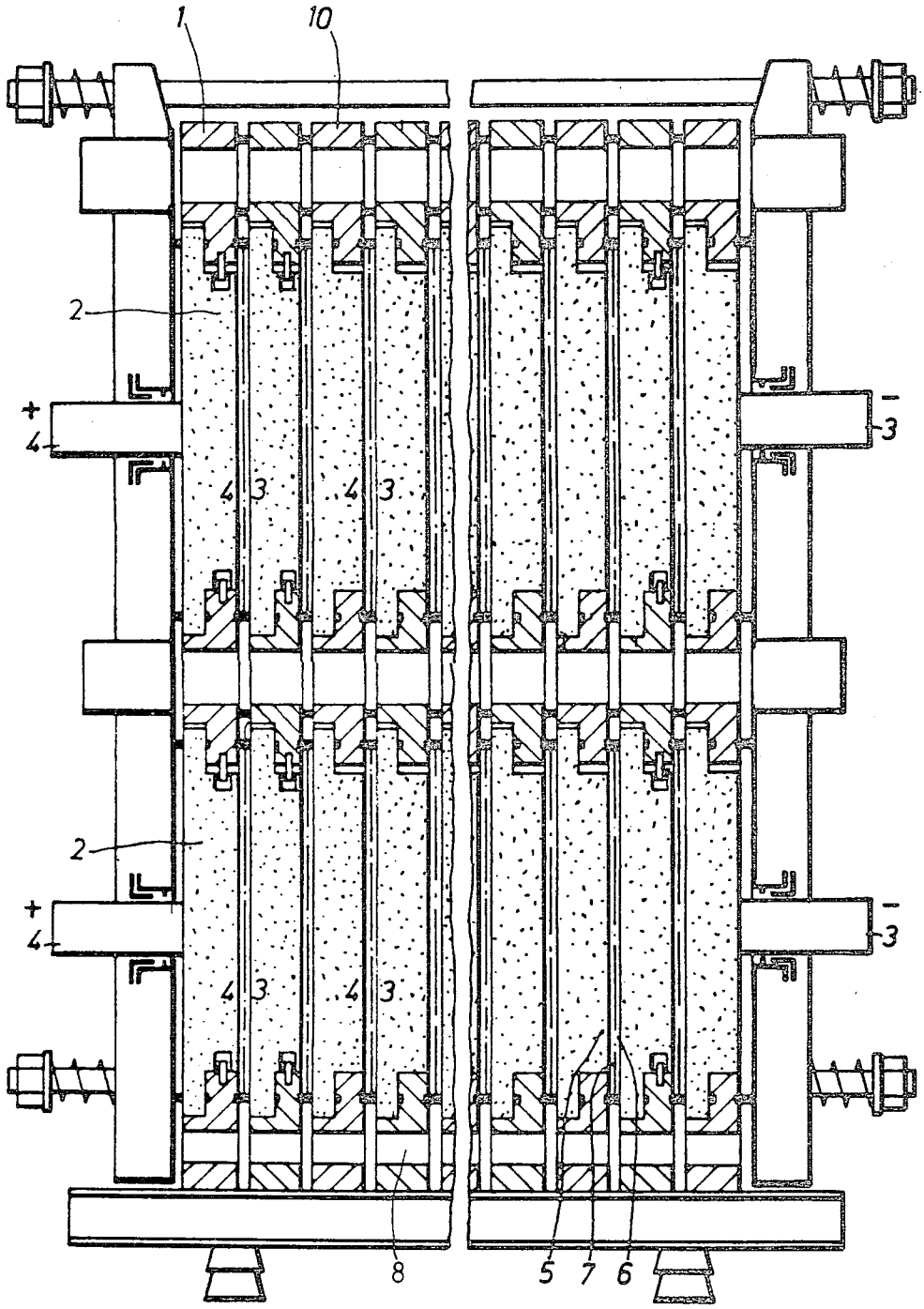
FIG. 1 shows a sample cross-section through a two-level electrolysis cell.

1. Electrode frame
2. Bipolar electrode
3. Cathode
4. Anode
5. Anolyte chamber
6. Catholyte chamber
7. Diaphragm
8. Anolyte inlet
9. Catholyte inlet
10. Anolyte and chlorine gas delivery pipe
11. Catholyte
12. Anolyte degassing
13. Catholyte degassing
A Anolyte
K Catholyte.

The process according to the invention is carried out using an electrolysis cell according to the invention in such a way that both catholyte and anolyte flow through the individual levels of the electrolysis cell in succession and are degassed after leaving one level and before entering the next level, the electrolytes being reduced in stages. About 25% hydrochloric acid is fed to the electrolysis cell both in the anolyte and in the catholyte cycle, the anolytic acid being able to have a somewhat higher concentration. The acid is reduced in several stages, finally to about 20% hydrochloric acid.

Electrolysis is preferably carried out at current densities of about 4 to 8 $kA/m^2$, preferably about 5 to 7 $kA/m^2$. The various levels of the electrolysis cell are preferably connected in parallel.

Figure 2:
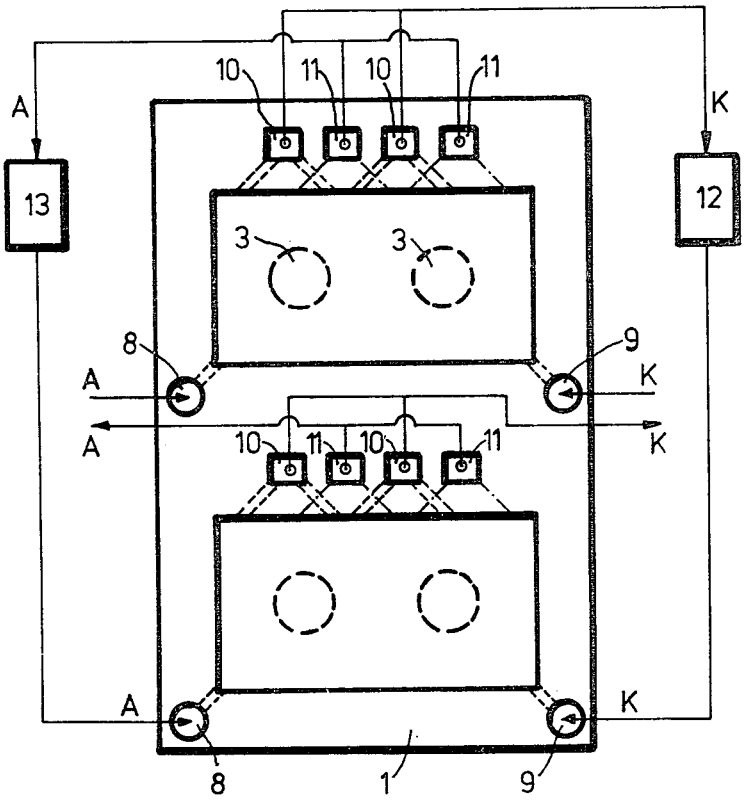
FIG. 2 shows a very simplified view of an electrode frame, taken in a perpendicular direction to the section shown in FIG. 1. The numerals indicated in the figures have the following particular meanings.

In order to avoid pressure differences in the electrolytes, the acid is preferably introduced initially into the uppermost level of an electrolysis cell and, after leaving one level and degassing, is introduced into the next level thereunder. Each level is preferably traversed from the bottom to the top in order to ensure that the gas bubbles are entrained and thus discharged at an accelerated rate. The preferred path of flow of anolyte and catholyte is illustrated in FIG. 2 by the arrows sketched in for a two-level electrolysis cell.

Thus, anolyte is first introduced near the middle at 8 and catholyte at 9. Electrolysis proceeds and anolyte leaves at the top at 11, the streams from all cells being combined, degassed at 13 and introduced at the bottom at 8. The catholyte streams 10 at the top are combined, degassed at 12 and introduced at 9 at the bottom. Anolyte and catholyte streams are removed at A and K near the middle.

The specific energy consumption during the electrolysis of hydrochloric acid is reduced by means of the invention, about 20% graphite being saved at the same time by the reduction of the active electrode surfaces required. Electrolysis can be carried out at the same voltage with a considerably increased current density rather than the formerly conventional current densities of about 4 $kA/m^2$. In addition, if the current density is to be maintained, a gain in voltage is achieved and this allows, for example, an increased number of bipolar electrodes to be connected in series in existing apparatus.

It will be appreciated that the instant specification and examples are set forth by way of illustration and not limitation, and that various modifications and changes may be made without departing from the spirit and scope of the present invention.

What is claimed is:

1. In the production of chlorine and hydrogen from hydrochloric acid by electrolysis in an electrolysis apparatus comprising multi-stages arranged in at least an upper and a lower stage and a plurality of vertically arranged bipolar electrodes in each stage, a diaphragm arranged between each two electrodes to divide the electrolysis chambers formed between them into an anolyte chamber and a catholyte chamber, and outlet and inlet devices for the electrolyte in each stage, the improvement which comprises electrolyzing the hydrochloric acid in at least two successive stages, and degassing the hydrochloric acid after leaving one stage and before introducing it into the next stage.

2. A process according to claim 1, wherein the concentration of the hydrochloric acid is reduced in successive stages.

3. A process according to claim 1, wherein the hydrochloric acid is first introduced into the inlet and withdrawn from the outlet at the top of the upper stage so as to traverse said stage from bottom to top, and is then introduced into the inlet at the bottom of the lower stage and withdrawn from the outlet so as also to traverse the lower stage from bottom to top.

4. In a hydrochloric acid electrolysis cell comprising a plurality of vertically arranged bipolar electrodes, a diaphragm arranged between each two electrodes to divide the electrolysis chamber formed between them into an anolyte chamber and a catholyte chamber, and outlet and inlet devices for the electrolytes, the improvement which comprises additional inlet and outlet devices provided in a horizontal plane perpendicular to the electrode surface thereby dividing each electrolysis cell into a plurality of superposed stages, the height of the partial electrode surface in each stage ranging from about 40 to 80 cm.

5. An electrolysis cell according to claim 4, in which the partial electrode surface in each stage formed by the division of the electrode is about 60 cm in height.

6. An electrolysis cell according to claim 4, including means for withdrawing hydrochloric acid from the outlet at the top of the upper stages, means for degassing the withdrawn hydrochloric acid, means for supplying the degassed hydrochloric acid to the inlet at the bottom of the lower stages, means for withdrawing electrolyzed hydrochloric acid from the outlet at the top of the lower stages, and means for degassing the withdrawn hydrochloric acid.

* * * * *